US005476398A

United States Patent [19]

de Givry et al.

[11] Patent Number: 5,476,398

[45] Date of Patent: Dec. 19, 1995

[54] PLUGGABLE ELECTRICAL CONNECTION DEVICE

[75] Inventors: Jacques de Givry, Les Loges en Josas; Jean-Claude Vallet, Velizy-Villacoublay, both of France

[73] Assignee: Matra Marconi Space France, Paris, France

[21] Appl. No.: 309,325

[22] Filed: Sep. 20, 1994

[30] Foreign Application Priority Data

Sep. 21, 1993 [FR] France ..... 93 11230

[51] Int. Cl.[6] ..... H01R 13/33

[52] U.S. Cl. ..... 439/841; 439/83

[58] Field of Search ..... 439/83, 817, 840–841, 439/852

[56] References Cited

U.S. PATENT DOCUMENTS

| | | | |
|---|---|---|---|
| 3,150,911 | 9/1964 | Matteson | 439/817 |
| 3,513,434 | 5/1970 | Zielke | 439/840 |
| 3,565,192 | 2/1971 | Stump | 317/101 |
| 3,639,978 | 2/1972 | Schurman | 439/817 |
| 4,161,346 | 7/1979 | Cherian et al. | 439/66 |
| 4,838,815 | 6/1989 | Tajima et al. | 439/817 |
| 4,907,263 | 3/1990 | Neuwirth | 439/817 |
| 5,030,109 | 7/1991 | Dery | 439/841 |

FOREIGN PATENT DOCUMENTS

| | | | |
|---|---|---|---|
| 195499 | 3/1907 | Germany . | |
| 2345629 | 3/1975 | Germany . | |
| 0223093 | 10/1924 | United Kingdom | 439/817 |

*Primary Examiner*—David L. Pirlot
*Assistant Examiner*—Jill DeMello
*Attorney, Agent, or Firm*—Larson and Taylor

[57] ABSTRACT

A pluggable electrical connection device comprises at least one pin-shaped male element of electrically conductive material and at least one female element. The female element is a metal coil spring having at least four turns sufficiently spaced apart to receive the male element between two mutually adjacent turns. The coil spring may have end portions which are bent to constitute tabs parallel to an axis of said coil spring and soldered to said support. It may also be locked between two elongated holes formed in two opposed sides of a cage and connected to a base circuit fast with said cage by pin.

11 Claims, 3 Drawing Sheets

FIG.7.
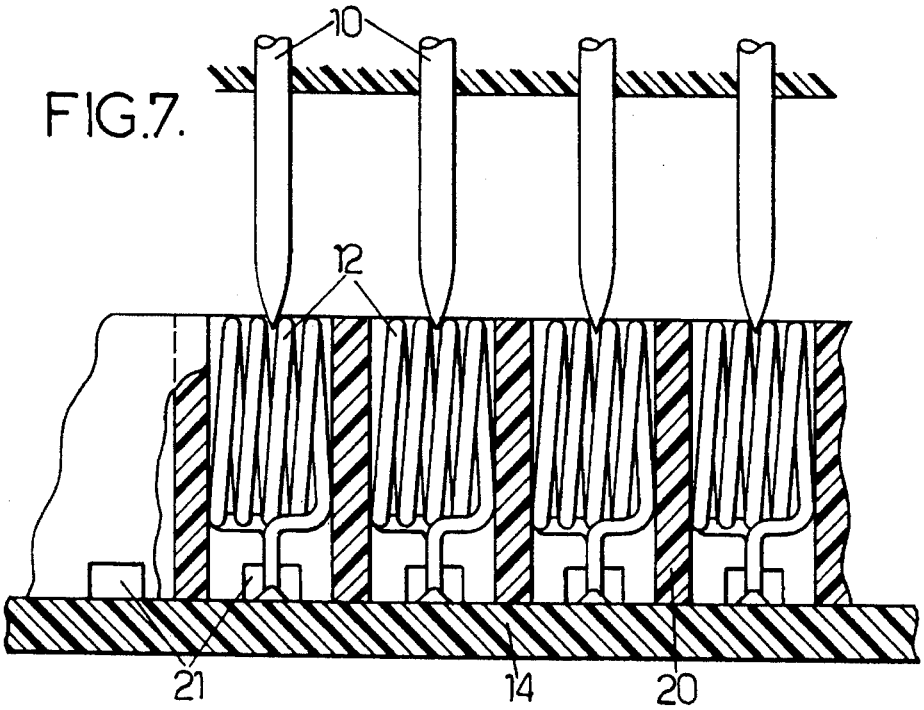
FIG.9.
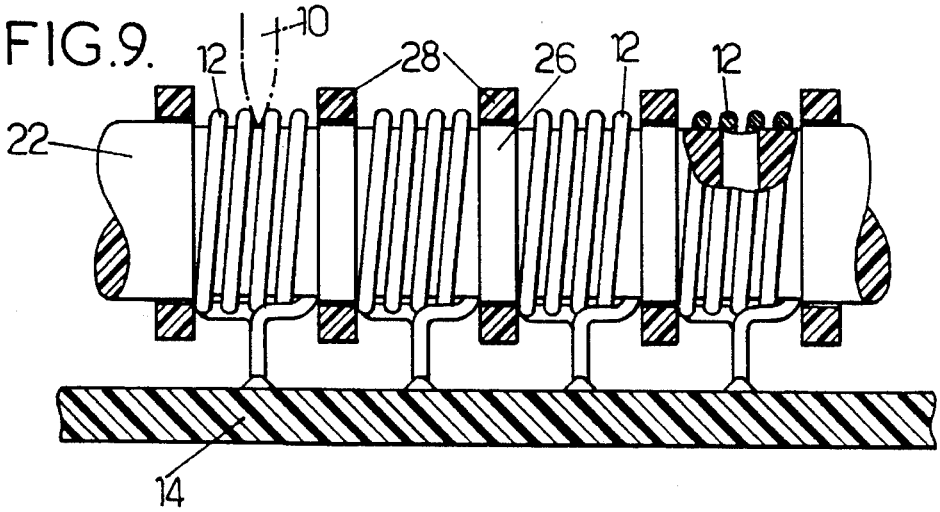
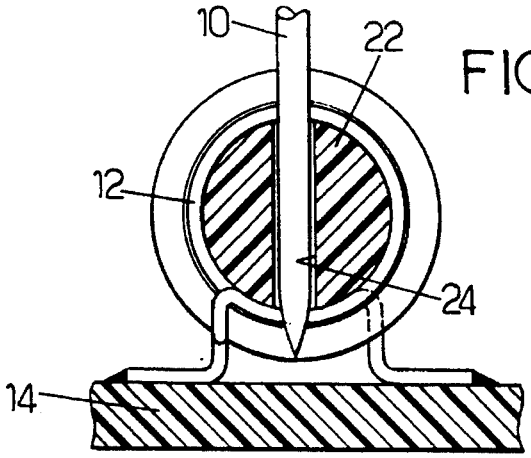
FIG.8.

PLUGGABLE ELECTRICAL CONNECTION DEVICE

BACKGROUND OF THE INVENTION

The invention relates to pluggable electrical connection devices designed for mounting a module or a sub-assembly on a support such as a printed circuit card. A major, but non-exclusive application thereof lies in mounting subassemblies in electronic equipment where, for example, it is often necessary to provide a mother card with connection elements designed to connect with complementary elements carried by mutually parallel daughter cards placed orthogonally to the mother card.

Most of the connection devices used at present establish an electrical connection by inserting a male element constituted by a round or flat pin in a female element constituted by a socket. A major drawback of such devices is that insertion can take place only if the cooperating male and female elements are accurately in alignment. In electronic circuits, where the contacts are distributed at a small pitch, the elements must often be brought into alignment with a tolerance of ±50 μm. This requirement gives rise to very tight tolerances in manufacture and in assembly.

SUMMARY OF THE INVENTION

An object of the present invention is to provide a connection device enabling so-called "surface-mounting" on a support, and capable of accomodating much larger alignment errors between the male and female elements than can be accomodated by previously known devices.

To this end, there is provided a pluggable electrical connection device comprising at least one male element in the form of a round or flat pin, and at least one surface-mounting female element. The female element is constituted by a coil spring having at least four turns sufficiently spaced apart to receive the male element between two turns. In a first preferred embodiment, the ends of the spring are angled to constitute solderable tabs for Surface mounting on a support.

Advantageously, at least one of the end portions of the spring is then folded parallel to its axis and bears against adjacent tongues so as to short-circuit the turns in order to reduce the self-inductance of the spring. The two end portions may typically be disposed symmetrically and the two tabs may then be in alignment in a mid-plane of the spring.

This structure makes it possible to accept very large tolerance in the positioning of the male element in all directions, and without degrading the electrical contact. Particularly, when the end of the male element is given a tapering shape, it is easily inserted between the central turns when the offset between its actual position and its nominal position is small, and otherwise it is inserted in one of the gaps on either side. In practice, the acceptable tolerance is frequently increased by as much as an order of magnitude compared with usual positioning tolerances.

The gap between two successive turns is frequently given a value that is approximately equal to the diameter of the wire from which the spring is made. Good results are then generally obtained by giving the male element a diameter or a thickness that is equal to about twice the diameter of the wire. Also as a general rule, it is often desirable to ensure that the relative dimensions of the wire constituting the spring, of the diameter of the male contact element, and of the gap between turns are such that the turns between which the male element is inserted are themselves forced into contact with the adjacent turns by the presence of the male element. The diameter of the spring will generally be in a range from ten times to twenty times the diameter of the wire.

In another embodiment of the invention, the electrically conductive coil is locked between two opposed sides of a cage which is connected to a base circuit by a pin, and projects into two elongated holes formed in the sides. The two mutually opposed sides of the cage may be covered with a metal layer to short-circuit the coil and to increase the electrical resistance. The device can comprise a plurality of electrically conductive coils.

BRIEF DESCRIPTION OF THE DRAWINGS

The invention will be better understood on reading the following description of particular embodiments given as non-limiting examples. The description refers to the accompanying drawings, in which:

FIGS. 6 and 7 are similar to FIGS. 1 and 2 and show a device having a plurality of contacts; and FIGS. 8 and 9, again similar to FIGS. 1 and 2, show another multicontact device;

DESCRIPTION OF PREFERRED EMBODIMENTS

Figure 1:
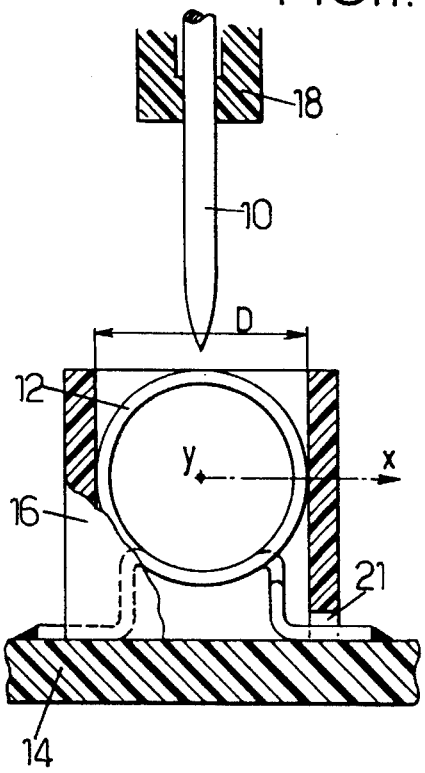
FIGS. 1 and 2 are respectively an elevation view and a lefthand end view of the essential components of a connection device having a single set of pluggable contact elements, the contact elements being shown separated.
Figure 2:
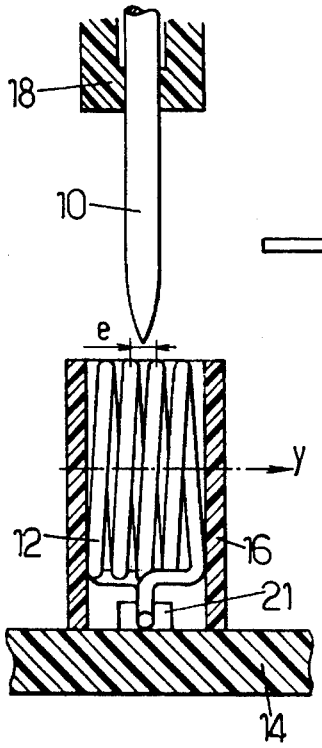
Figure 3:
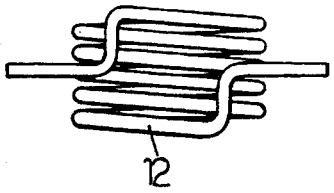
FIG. 3 is a plan view of the female element in the device of FIGS. 1 and 2.

The connection device shown by way of example in FIGS. 1 and 2 includes a male element 10 constituted by a pin. The female element of the device is constituted by a coil spring made of metal wire, generally copper or beryllium wire coated with a thin film of gold. The spring shown has four turns, but that number is not limiting. Nevertheless, it is the minimum number that makes it possible to achieve tolerance on the position of the element 10 that is greater than the pitch e of the spring. Each of the two end portions of the spring has three successive bends. The first bend serves to constitute a length that bears against two turns situated on the same side of the mid plane, thereby reducing the resistance and the inductance of the female element when in the plugged condition. Beyond the last bend, the ends of the spring-constituting wire form two tabs that are in line with each other in the mid plane, thereby enabling the female element to be fixed by brazing or soldering to a support 14, e.g. constituted by a printed circuit card.

For micro-electronic applications in particular, it is possible to use a spring having a diameter D of about 3 mm and made of a wire having a diameter of about 0.2 mm. The gap between two successive turns may be of the same order as the diameter of the wire. The gap will often be approximately equal to half of the diameter or thickness of the male element. Nevertheless, such dimensions are not limiting in any way.

For a connector that is designed to provide one contact only, the female element may be placed in a housing constituted by a cage 16 made of thin insulating material and in which notches 21 are formed through which the tabs pass. The cage avoids any risk of short circuiting between adjacent female elements and it limits the lateral forces on the turns. The male element may itself be mounted in an insulating body 18 in permanent or in removable manner. The body 18 may also serve to limit the instant to which the male element can be pushed into the female element.

The end of the male element has a generally tapering shape with a tip that is pointed, or more generally that is rounded. When the elements are being plugged together, if the offset along the axis y (FIG. 2) does not exceed e/2 relative to the nominal position, then the male element is inserted between the middle two turns of the spring, which move progressively away from their rest positions. The device also accomodates large offsets in the direction of the axis x (FIG. 1), particularly when the male element is in the form of a pin.

Figure 5:
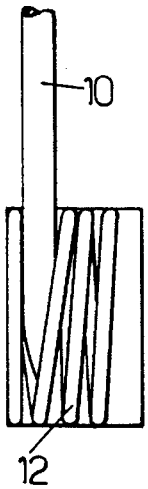

If the positioning error exceeds e/2, then the male element 10 is engaged between two lateral turns, as shown in FIG. 5.

Thus, with a female element constituted by a spring made of a wire having a diameter of 0.2 mm and having gaps between turns of 0.25 mm, the latitude in positioning along the axis y can be as great as ±0.8 mm.

Figure 4:
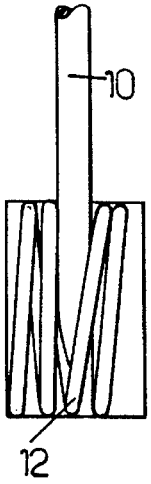
FIGS. 4 and 5 are similar to FIG. 2 and show two possible positions that can be taken up by the male and female elements when plugged together.

The plugging stroke is designed so that at the end of the stroke, the cylindrical portion of the pin bears against the turns (FIG. 4). The sliding of the surfaces one against another has a self-cleaning effect.

The device may also have multiple contacts. In the example shown in FIG. 6 and 7 (where members corresponding to those already shown in FIGS. 1 to 5 are given the same reference numerals), the female elements are mounted in a strip of insulating material 20. The strip will generally be made of a thermosetting material or of a molded thermoplastic material (e.g. diallyl phthalate). A plurality of parallel passages are formed in the strip 20 at regular intervals, each receiving a female element having tabs that pass through the strip via slots 21. These elements are thus held at a regular pitch.

Such a strip 20 also enables the female elements to be surface-mounted on a support 14 such as a printed "mother" circuit. The female elements may be designed to receive the male contact elements of modules or of daughter cards.

Figure 6:
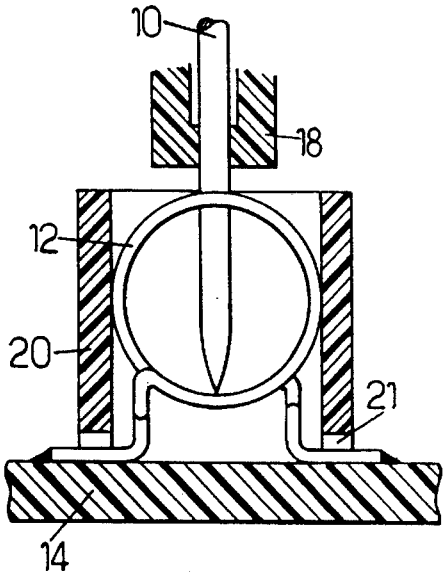

In FIG. 6, the device is designed so that the male elements pass through the top portions only of the turns. However, by pushing the pins 10 in deeper, it is also possible to obtain redundant contact.

In the variant shown in FIGS. 8 and 9, a multiple contact device is made by threading a plurality of female elements 12 onto an insulating bar 22 through which diametral holes 24 are formed at regular intervals to the purpose of receiving the male elements 10. Portions 26 of slightly larger diameter may be provided between the locations for the female elements. The diameter of these portions is such as to enable the female elements to be threaded into position by camping their ends together so as to open them up a little. Finally, insulating washers 28 may be threaded onto the bar to alternate with the female elements and avoid short circuits between them.

The female portion of any of the connection devices described above can be surface-mounted using machines of the type commonly available at present. The female contacts may receive modules of arbitrary type or test pins. In all cases positioning tolerance is large. The resulting electrical contact has low resistance, particularly when the male element is constituted by a cylindrical pin that bears against a wire that is itself cylindrical; the rubbing that takes place during engagements guarantees self-cleaning. Manufacturing cost is low. Electrical resistance and self-inductance are small because the turns are short-circuited together. The high degree of flexibility and the low mass of the springs guarantees good performance under conditions of vibration. Numerous variants of the invention are possible, particularly with respect to the shape of the male elements (which may be flat pins of rectangular section that is elongate in the ex direction of FIG. 1, or even square section pins suitable for wire wrapping), and it is possible to group a plurality of female elements together in a common insulating housing.

Figure 10:
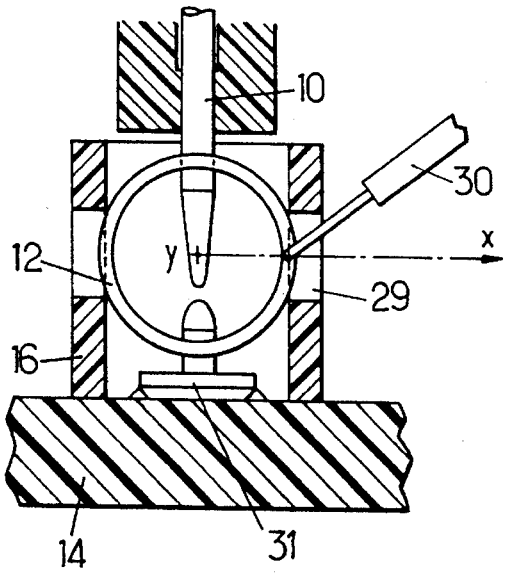
FIGS. 10 and 11, also similar to FIGS. 1 and 2 show another embodiment with either one or a plurality of connecting pins.
Figure 11:
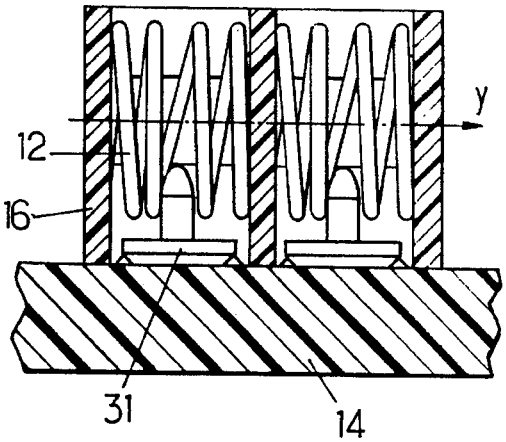
Figure 12:
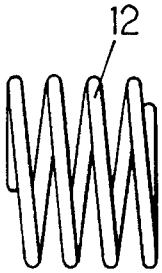
FIG. 12 is a plan view of the female element in the device of FIGS. 10 and 11.

For example, FIGS. 10 and 11 show another embodiment of the invention. The connecting device comprises a male element 10 and a female element 12. The male element 10 is similar to that described; the female element 12 comprises a coil which has no brazed ends and consequently need not have straight end portions. The coil is electrically connected to the base circuit card 14 by a pin 31 brazed on the surface of this base material 14. The coil is retained in a cage. For that purpose two elongated holes 29 are formed in two opposed sides of the cage 16. The size of the elongated holes 29 is such that the coil may be locked by forcing it into the holes 29 and no contact between mutually adjacent coils 12 exists, if there are a plurality of adjacent connections. The two mutually opposed sides of the cage 16 may be covered with a metal layer in order to short-circuit the coil and to increase the electrical resistance. The shape of the coil and its handling are simple, the coil can withstand the input and output efforts of the male pin and a test pin terminating a cord can be inserted through one of the elongated holes 29.

We claim:

1. Pluggable electrical connection device comprising:

a plurality of pin-shaped male elements of electrically conductive material;

a plurality of female elements each constituted by a metal coil spring having at least four turns sufficiently spaced apart to receive the male element between two mutually adjacent turns thereof and sufficiently close to be in contact with a respective one of said male elements, said coil springs being mutually identical and having mutually aligned longitudinal axes; and a strip of insulating material formed with a plurality of separate passages each for receiving one of said coil springs formed at regular intervals.

2. Device according to claim 1, wherein each male element has a thickness and said turns define a gap which is approximately equal to half the thickness of the male element.

3. Device according to claim 1, wherein said coil spring has a diameter between ten times and twenty times a diameter of wire constituting said coil spring.

4. Pluggable electrical connection device for surface mounting comprising:

a printed circuit support, at least one pin-shaped male element of electrically conductive material;

at least one female element constituted by a metal coil spring having at least four turns sufficiently spaced apart to receive the male element between two mutually adjacent turns, having end portions which are bent to constitute tabs parallel to an axis of said coil spring and soldered to said support.

5. Device according to claim 4, wherein said two end portions are disposed symmetrically and the two tabs are in alignment in an axial plane of the coil spring.

6. Pluggable electrical connection device comprising:

at least one pin-shaped male element of electrically conductive material;

at least one female element constituted by a metal coil spring having at least four turns sufficiently spaced apart to receive the male element between two mutually adjacent turns thereof and sufficiently close to be in contact with said male element;

a base circuit provided with a pair of mutually parallel-walls separated by a distance smaller than a diameter of said coil spring and formed with respective elongated openings for receiving side portions of said coil spring and retaining said coil spring; and another electrically conductive pin secured to said base circuit, projecting between two successive turns of said coil spring and in contact therewith.

7. The device according to claim 6, wherein the two mutually opposed sides of the cage are covered with a metal layer.

8. Pluggable electrical connection device comprising:

at least one pin-shaped male element of electrically conductive material;

at least one female element constituted by a metal coil spring having at least four turns sufficiently spaced apart to receive the male element between two mutually adjacent turns thereof and sufficiently close to be in contact with said element; and an insulating bar on which said plurality of coil springs are threaded at regular intervals, said insulating bar being formed with diametral passages for receiving said male ends.

9. Device according to claim 8, comprising insulating washers threaded onto the bar alternately with the coil springs.

10. Device according to claim 8, wherein said insulating bar has bulged portions separating locations that receive the coil springs.

11. Pluggable electrical connection device for surface mounting comprising:

a printed circuit support, at least one pin-shaped male element of electrically conductive material; and at least one female element constituted by a metal coil spring having at least four turns sufficiently spaced apart to receive the male element between two mutually adjacent turns, having end portions which are bent to constitute tabs parallel to an axis of said coil spring and soldered to said support, the two end portions of said female element being disposed symmetrically and the two tabs being in alignment in an axial plane of the coil spring.

* * * * *